US005107549A

United States Patent [19]

Pitts et al.

[11] Patent Number: 5,107,549

[45] Date of Patent: Apr. 28, 1992

[54] DISPOSABLE TOILET SEAT COVER

[76] Inventors: John L. Pitts, 4437 Clemice La., Montgomery, Ala. 36106; Lawrence F. Pitts, 1220 Stonecrest Dr., Birmingham, Ala. 35235

[21] Appl. No.: 523,988

[22] Filed: Feb. 11, 1991

Related U.S. Application Data

[63] Continuation of Ser. No. 312,875, Feb. 21, 1989.

[51] Int. Cl.[5] ..... A47K 13/14

[52] U.S. Cl. ..... 4/243; 4/247

[58] Field of Search ..... 4/242, 243, 247; 150/154

[56] References Cited

U.S. PATENT DOCUMENTS

| | | | |
|---|---|---|---|
| 2,504,350 | 4/1950 | Reeves | 150/154 |
| 2,532,316 | 12/1950 | Larkin | 150/154 |

FOREIGN PATENT DOCUMENTS

| | | | |
|---|---|---|---|
| 3331740 | 3/1984 | Fed. Rep. of Germany | 4/247 |
| 238215 | 10/1986 | Japan | 4/243 |
| 0050007 | 1/1932 | Norway | 4/247 |

*Primary Examiner*—Charles E. Phillips

*Attorney, Agent, or Firm*—Hopkins & Thomas

[57] ABSTRACT

A disposable toilet seat cover is disclosed, the cover being designed to fit over and around horseshoe or U-shaped toilet seats. The cover is tubular in design with open ends and is composed of a biodegradable material for immediate disposal in the toilet after use of the cover.

6 Claims, 2 Drawing Sheets

DISPOSABLE TOILET SEAT COVER

This is a continuation of copending application Ser. No. 07/312,875 filed on Feb. 21, 1989.

BACKGROUND OF THE INVENTION

Sanitation has always been a problem with regard to toilet seats, particularly in public bathrooms. Wiping the seat prior to use may even be ineffective against some disease-causing organisms such as bacteria and viruses.

Several attempts have been made to address this problem. One relatively common means is the use of a circular cover which sits on the top portion of the toilet seat, with no means of securement thereon, thus this type of cover is prone to dislocation from its initial positioning. A reference to Kakiuchi, Japanese Patent No. 61-238215 teaches a configuration in which the legs 1 and 2 of the cover receive the ends of a U-shaped toilet seat, thus leaving a gap in the center. This is clearly shown in FIG. 4 where the Kakiuchi cover is shown in installed position.

The reference to Hefty et al., U.S. Pat. No. 4,213,212, and to Asberg, Swedish Patent No. 87682, are essentially the same and it is believed that they can be discussed together. Both references disclose a continuous tubular toilet seat cover that includes a supply reel and a take-up reel, the cover being fed around a round toilet seat from back to front and then toward the back again to complete the circle. After use, the used portion is wound up on the take-up reed which in turn pulls a new segment of the continuous tubular member around the toilet seat. In both of these references, the cover is introduced from the back edge and proceeds around the front of the seat to the opposite rear edge of the seat. In addition, both the Asberg and Hefty et al. covers are continuous so that they may be wound around the seat from the supply reel to the take-up reel. These references involve a substantial investment in the mechanisms and in the continuous threading of the reels in order for the inventions to work as they are designed.

Thus, it can be seen that a need continues to exist for a toilet seat cover that avoids the disadvantage of the known prior art. It is to this need that the present invention is addressed.

SUMMARY OF THE INVENTION

It is therefore, one of the principal objects of the present invention to provide a toilet seat cover that is easily and quickly applied and which is easily disposed of after use.

A further object of the present invention is to provide a toilet seat cover that is inexpensive to produce and to use and which is biodegradable to facilitate its disposal.

A still further object of the present invention is to provide a toilet seat cover designed for a single-use application and which is conveniently stored, preferably utilizing a roll upon which the product is wound.

These and additional objects are attained by the present invention which relates to a disposable toilet seat cover, being generally tubular in design. The cover is designed to be used on a horseshoe-shaped toilet seat which is hinged at the back and has opposed ends defining an opening or gap at or near the front portions thereof. The cover is normally composed of a biodegradable paper material and is supplied on a roll like toilet paper or in a box, similar to that used for dispensing tissues. The cover is of a length sufficient to completely receive the seat therein and of a diameter sufficient to completely encompass the seat.

Various other objects and advantages of the present invention will become apparent from the following description, with reference to the accompanying drawings.

DETAILED DESCRIPTION OF THE PREFERRED EMBODIMENT

Figure 1:
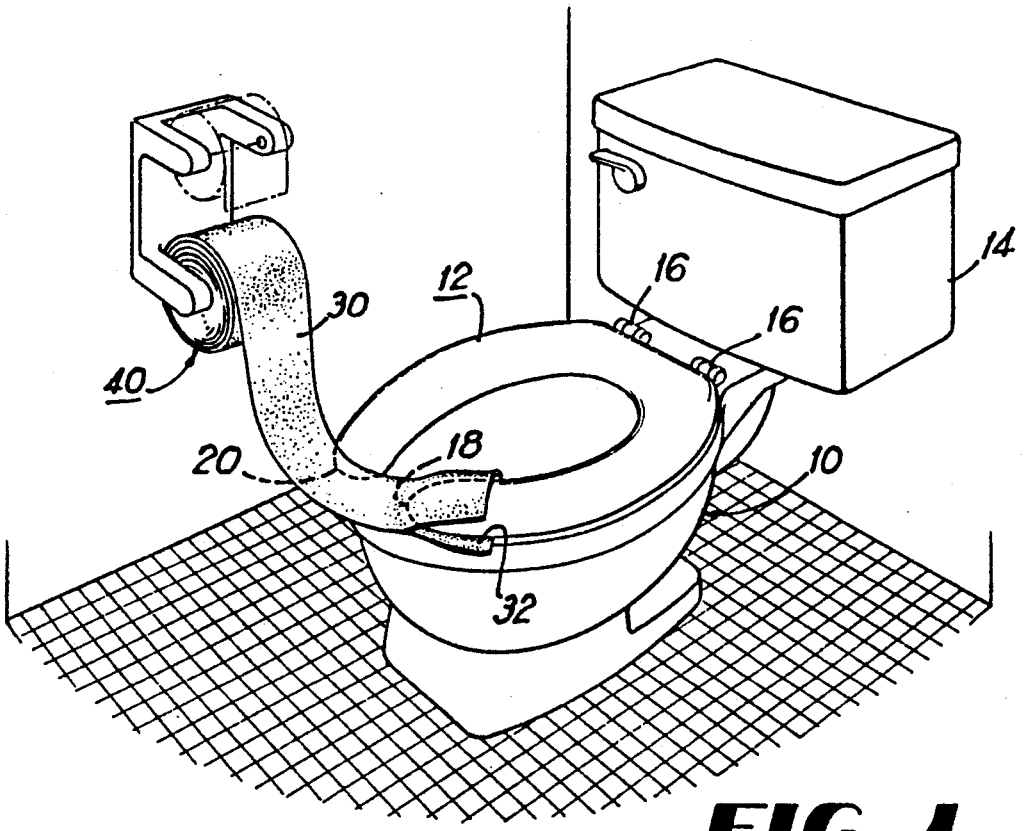
FIG. 1 is a perspective view of the initial step in installing the present invention on a toilet seat.

Referring now more specifically to the drawings, and to FIG. 1 in particular, numeral 10 designates generally a toilet having a horseshoe-shaped seat 12. It is this type of seat to which the present invention is directed, the seat being hinged at the back portion thereof near the water storage tank 14 with hinges 16. The front portion of the seat has opposed ends 18 and 20 which are not connected and form a gap or openings therebetween, as illustrated by the phantom lines in FIGS. 1–3. Thus, the gap is disposed near the front rim of the toilet bowl 22, opposite the hinged portion of the seat.

Figure 3:
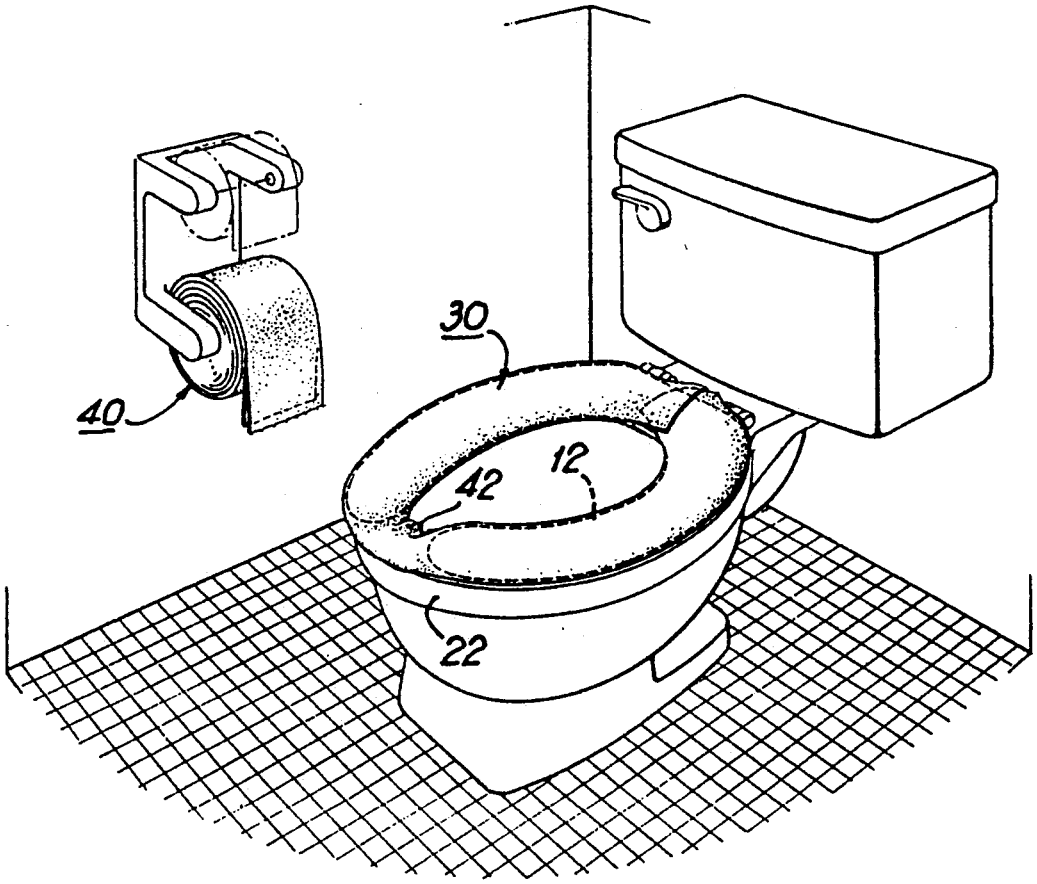
FIG. 3 is a perspective view showing the completed installation, the cover fully in place and ready for use.
Figure 4:
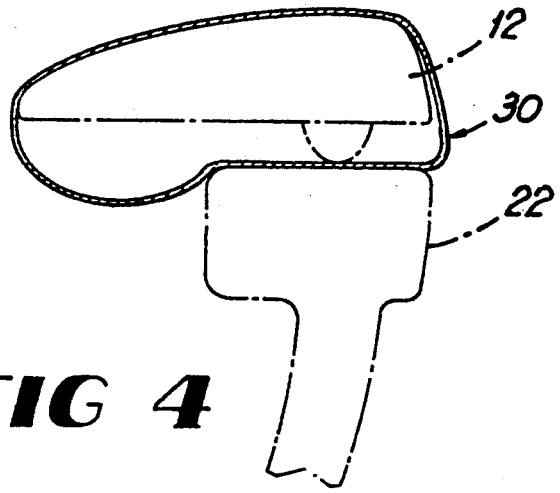
FIG. 4 is a cross-sectional view of the installed cover, the section being taken on line 4—4 of FIG. 3.

The present invention involves a cover 30 of tubular design with open end portions. Each of the end portions receive, respectively, one of the opposed ends of the toilet seat, the installation being shown sequentially in FIGS. 1 through 3. The cover 30 is of a length sufficient to completely receive the seat therein, and for the opposed ends to overlap slightly at the back portion of the seat near the seat hinges. The cover is also of sufficient diameter to completely encompass the seat, as shown in FIG. 4. The cover may be made in varying lengths and diameters so as to fit a plurality of different-sized seats and length or diameter are not meant to be limiting in that sense. The length and diameter are important, however, in the sense that the cover completely enclose the seat so as to provide hygenic conditions.

Figure 2:
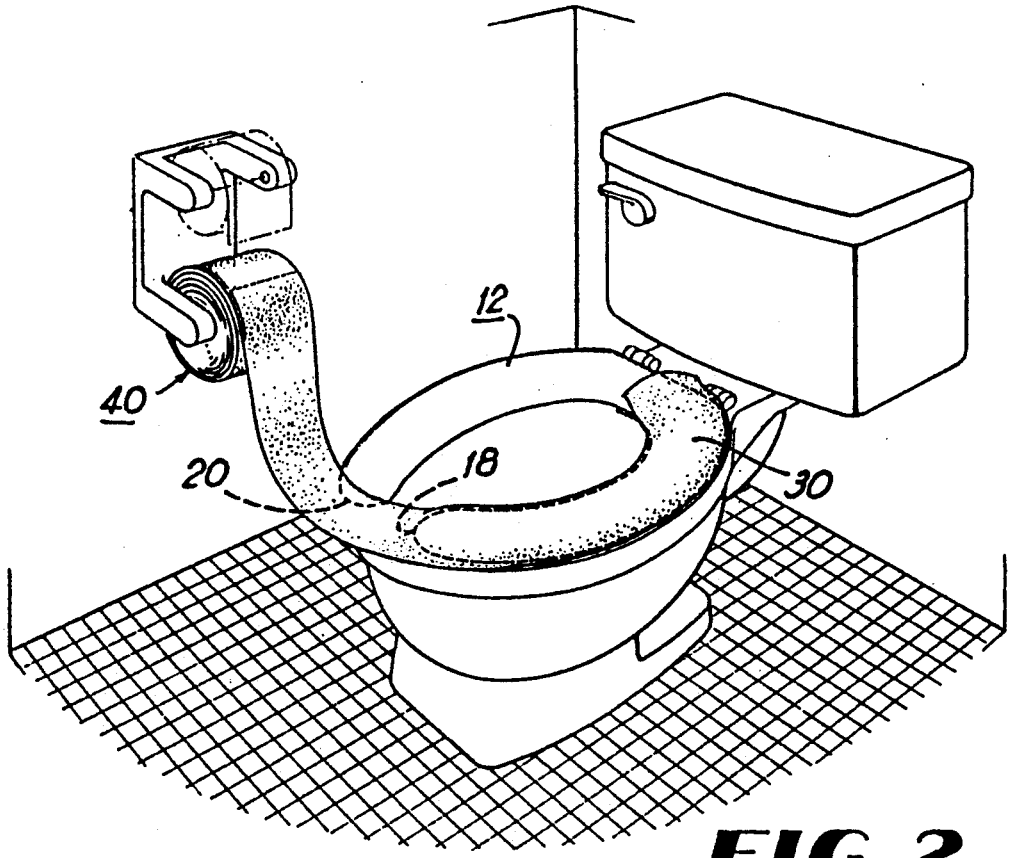
FIG. 2 is a perspective view of the continuing installation of the present cover.

The covers may be slit along the edge portions thereof and near their opposite ends, for aiding in the opening of the tubular cover for initial installation, this being shown in FIG. 1 by slit 32. In the sequence of installation, the cover is grasped from, for example, a storage roll 40 and one end is fed over and around one of the opposed ends of the seat. The cover is slid on to the seat toward the back portion thereof, as shown in FIG. 2. The other end of the cover is then slid over and around the other, uncovered side of the seat, toward the back where it meets the first end of the cover. The central portion 42 of the cover is disposed so as to span the gap between the opposed ends of the seat, thereby providing further protection against contact with the seat, bowl, rim, etc. After use, this central portion 42 may then be conveniently grasped to pull the cover off of the seat for disposal in the toilet.

The present invention is preferably composed of a biodegradable paper material and may be supplied in roll form as shown in the drawings, with serrations 44 being formed in the roll for ease of separating the individual lengths of covers 30. Alternatively, the covers may be supplied in a box or travel pack so as to be readily available where a roll of covers is not supplied.

It is also contemplated, as an additional feature of the present invention, that an antiseptic means be applied to the covers during the manufacturing process to further enhance its hygenic purpose. The cover is designed to be simple in construction and use, being easily applied even by children, and yet to provide substantially complete protection against contact with the underlying seat. Thus, the present cover provides an effective defense against the generally unknown sanitary state of toilet seats, having a horseshoe or U-shaped design, a common design in public facilities.

While an embodiment of a disposable toilet seat cover and modifications thereof have been shown and described in detail herein, various additional changes and modifications may be made without departing from the scope of the present invention.

I claim:

1. A single use toilet seat cover for substantially covering a horseshoe-shaped toilet seat, the seat having right and left sides with an opening therebetween disposed near the front of the rim of a toilet bowl and a hinged connection to the toilet bowl at the rear portion of said seat opposite said opening, said cover comprising a tubular member having open, free end portions and being of a length sufficient to substantially cover said toilet seat for a single use application, one of said portions receiving one side of said toilet seat and the other of said end portions receiving the other side of said toilet seat, said end portions being threaded over said sides of said seat from the front of said seat to the back of said seat, an intermediate portion of said cover spanning said gap between the opposed ends of said seat and each of said end portions having an axially extending slit for receiving said hinged connection.

2. A toilet seat cover as defined in claim 1 in which said cover is of sufficient length for said end portions to overlap one another near the rear portion of said seat opposite said opening.

3. A toilet seat cover as defined in claim 1 in which said tubular member is of a diameter sufficient to encompass said seat.

4. A toilet seat cover as defined in claim 1 in which said tubular member is composed of paper for allowing disposal of said cover in said toilet.

5. A toilet seat cover as defined in claim 1, wherein said cover being supplied in connected form with at least one additional cover being separably connected to said first mentioned cover at one of said ends and being detachable therefrom for use in covering said seat.

6. A method of applying a single use toilet seat cover for covering a horseshoe-shaped toilet seat having a pivoted connection to a toilet at the back of said seat and opposed ends disposed near one another at the front of said seat opposite said pivoted connection and defining a gap, said bowl having an upper rim upon which said seat is supported, a portion of which is exposed by said gap between said opposed ends, said cover being of tubular form with open ends and having an intermediate portion between said open ends, the method of use comprising the steps of:

a) threading one end of said cover over one of said opposed ends of said seat from the front toward the back; and b) threading the opposite end of said cover over the other of said opposed ends of said seat from the front to the back; and c) disposing the intermediate portion of said cover across said gap.

* * * * *